US009151185B2

(12) United States Patent
Kirchner et al.

(10) Patent No.: US 9,151,185 B2
(45) Date of Patent: Oct. 6, 2015

(54) STEAM POWER PLANT WITH STEAM TURBINE EXTRACTION CONTROL

(71) Applicant: ALSTOM Technology Ltd, Baden (CH)

(72) Inventors: Julia Kirchner, Gernsheim (DE); Volker Schüle, Leimen (DE); Stefan Hellweg, Oetigheim (DE)

(73) Assignee: ALSTOM Technology Ltd, Baden (CH)

( * ) Notice: Subject to any disclaimer, the term of this patent is extended or adjusted under 35 U.S.C. 154(b) by 123 days.

(21) Appl. No.: 14/046,132

(22) Filed: Oct. 4, 2013

(65) Prior Publication Data

US 2014/0096522 A1 Apr. 10, 2014

(30) Foreign Application Priority Data

Oct. 5, 2012 (EP) ..... 12187352

(51) Int. Cl.
*F01K 7/34* (2006.01)
*F01K 7/22* (2006.01)
*F01K 7/24* (2006.01)

(52) U.S. Cl.
CPC ... *F01K 7/34* (2013.01); *F01K 7/22* (2013.01); *F01K 7/226* (2013.01); *F01K 7/24* (2013.01); *F01K 7/345* (2013.01)

(58) Field of Classification Search
CPC ..... F01K 7/34; F01K 7/226; F01K 7/22; F01K 7/345; F01K 7/24
USPC ..... 60/653, 677–680
See application file for complete search history.

(56) References Cited

U.S. PATENT DOCUMENTS

| | | | | |
|---|---|---|---|---|
| 3,998,058 | A * | 12/1976 | Park | 60/652 |
| 4,372,125 | A * | 2/1983 | Dickenson | 60/660 |
| 5,605,118 | A | 2/1997 | Sinn et al. | |
| 5,836,162 | A * | 11/1998 | Haynes | 60/663 |
| 6,109,019 | A | 8/2000 | Sugishita | |
| 2011/0048011 | A1 | 3/2011 | Okita et al. | |
| 2011/0056201 | A1* | 3/2011 | Kluge et al. | 60/653 |
| 2012/0233978 | A1* | 9/2012 | Chillar et al. | 60/39.182 |
| 2012/0266598 | A1* | 10/2012 | Goto et al. | 60/679 |

FOREIGN PATENT DOCUMENTS

| | | |
|---|---|---|
| DE | 44 47 044 | 4/1996 |
| EP | 2 444 596 | 4/2012 |
| FR | 2 016 921 | 5/1970 |
| WO | 2009/129166 | 10/2009 |
| WO | 2011/057881 | 5/2011 |
| WO | 2011/141942 | 11/2011 |

* cited by examiner

*Primary Examiner* — Hoang Nguyen

(57) ABSTRACT

Provided is a power plant and a method of operating thereof. The power plant includes a boiler for heating process fluids; and a multistage first steam turbine with an outlet line that passes through the boiler. The outlet line includes an extraction line that is configured and arranged to extract steam from an intermediate stage of the first steam turbine and heat at least one of the process fluids.

10 Claims, 2 Drawing Sheets

STEAM POWER PLANT WITH STEAM TURBINE EXTRACTION CONTROL

CROSS-REFERENCE TO RELATED APPLICATIONS

This application claims priority to European application 12187352.5 filed Oct. 5, 2012, the contents of which are hereby incorporated in its entirety.

TECHNICAL FIELD

The invention relates generally to a method and system for controlling a steam power plant and more specifically to the use of extraction to control the hot reheater temperature of a steam generator of the power plant, in particularly at low turbine loads.

BACKGROUND INFORMATION

As described in the U.S. Pat. No. 5,605,118, a modern steam generator can include a complex configuration of various thermal and hydraulic units for preheating and evaporating water and generating superheated steam. Such units are typically designed to ensure complete and efficient fuel combustion while minimizing emissions of particulate and gaseous pollutants, steam generation at a desired pressure, temperature and flow rate; and maximize recovery of the heat produced upon combustion of a fuel.

Steam generators typically form part of steam plants that further include a series of steam turbines that extract work from steam from the steam generator and a condensate return system in which condensed steam is returned to the steam generator. As described in PCT patent application 2011/057881 A1 steam may be extract from an intermediate stage of the last steam turbine of the series and used-to pre heat condensate before it enters the enters a steam generator. As discussed in PCT application no. 2011/141942 A1, intermediate stage extraction may also be used to regenerate a working fluid in organic Rankine Cycles.

Reheaters and superheaters of a modern steam generator typically have specially designed tube bundles that are capable of increasing the temperature of saturated steam to specific steam outlet temperatures, while ensuring metal temperatures do not become too hot and steam flow pressure losses are minimised. Essentially, these reheaters and superheaters are single-phase heat exchangers comprising tubes through which steam flows, and across which the combustion or flue gas passes. Typically, reheater and superheater tube bundles are made of high temperature steel alloys.

The reheater typically provides steam for a second steam turbine that fluidly follows a first steam turbine that typically is fed directly from a feed water cycle that passes through the steam generator. Referring to the respective state of expansion, the first steam turbine is typically known as high-pressure or HP steam turbine and the second steam turbine or steam turbine group as the intermediate pressure or IP steam turbine/steam turbine group.

For carbonaceous fuel boiler-turbine power plants, it can be important for the heat rate and cycle efficiency to regulate and control reheater steam temperature within narrow limits to ensure that hot reheat temperature is kept close to nominal levels. This can be particularly challenging when a power plant operates at low load, for example during start-up when the pressure of the reheat section is very low. Depending of the type of steam generator or boiler, under such conditions, the reheater outlet temperature (RHO) required at main continuous rated (MCR) conditions may not be achieved. As a consequence, the IP steam turbine will not receive steam heated to the optimal operating temperature thus requiring control measures to be implemented.

In designs where the reheater surface is maintained in a condition conducive to convective heat transfer, a known method for controlling reheater temperature involves increasing or reducing the flue gases flowing over heater sections thus utilising variations in thee convective heat transfer coefficient. This method is most often used in wall fired units where the second pass of the boiler is divided in to two parallel paths up to the economizer and reheater. Typically, such designs ensure that a one third two third ratio of flow area between the low temperature superheater and the reheater is achieved. For such arrangements, dampers may be located at the bottom of flue gas passages where they, may be used to optimise flue gas flow. Advantageously the dampers may be located in the bigger flow area so that closing of the dampers will divert flue gas to the smaller flow area where the reheater surface is located. This increases the pickup in the reheater steam and thus increases the outlet temperature of the reheater. Alternatively, reducing the flow by opening the damper in the other parallel path will reduce the flue gas flow through the reheater section and thus reduce the reheater steam outlet temperature. Even though the logic of this design is simple, the use of such systems in coal and low grade fuels systems can cause construction and maintenance challenges.

Another method of controlling reheat steam temperature involves shifting the burner flame in the boiler. This is particularly applicable for tangential fired boilers. In this method burners are located in corners and tilted up or down in unison to increase radiant heat going to the reheater surface, thus affecting the superheater heat absorption. The burner tilting mechanism is so designed that all the burners in all corners tilt up or down based on the reheater outlet steam temperature. It has been the experience of some operators using low grade coal that if burners are not regulated moved, the tilting mechanism has a tendency to seize. A second problem with this method is that during low load operation, the effect of burning tilting may not be enough to prevent the hot reheat temperature dropping off more than the live steam temperature.

German patent application no. 44 47 044 C1 discloses another method of adjusting reheat temperature that involves extracting upstream of a first high pressure steam turbine and adding this extracted steam to exhaust steam of the high pressure steam turbine before the exhaust steam is reheated.

Other alternate methods for reducing reheat steam temperature also exist. For example, water sprays, also called direct contact attemperation or de-superheating, can be introduced into the fluid entering the reheater. One problem with this solution is that it can have a negative effect on cycle efficiency. Another method is to use excess air supplied to the boiler to control reheater steam temperature. This method can also have a negative effect on boiler efficiency. Further solutions include drawing off steam from the super heater and/or reheater, leaving, however, the problem of finding a disposal path for the extracted steam. An additional disadvantage of all these alternate methods is that they can only be used to reduce reheat temperature and therefore are not effective when the reheat temperature needs to be preferably increased.

In view of the prior art it is seen as an object of the present invention to provide more efficient means and methods for controlling the temperature of the reheater, particularly at low (i.e sub-operational) loads or pressure in the steam path.

SUMMARY

A power plant is disclosed that can operate efficiently at low loads. The power plant addresses the problem of low efficiency at low loads by means of the subject matters of the independent claims. Advantageous embodiments are given in the dependent claims.

An aspect provides a power plant with a boiler for heating process fluids and a multistage first steam turbine with an outlet line that passes through the boiler. The outline line includes an extraction line that is configured and arranged to extract steam from an intermediate stage of the steam turbine and use this steam to heat at least one of the process fluids.

An aspect further provides a control system comprising a control valve, in the extraction line, for modulating flowrate through the extraction line. The control system further includes a temperature measurement device that is configured and arranged to measure a temperature of process fluid in the outlet line; and a control device that is configured and arranged to modulate the control valve based on the temperature measurement.

A further aspect provides that the extraction line is connected to the outlet line upstream of the boiler.

A further aspect of the power plant includes a boiler feed water line that passes through the boiler and a first preheater in the boiler feed water line upstream of the boiler. A steam line fluidly connects the outlet line upstream of the boiler to the first preheater so as to enable pre-heating of boiler feed water.

Another aspect provides that the extraction line is connected to the outlet line upstream of the steam line.

Another aspect provides that the extraction line is connected to the outlet line between the boiler and the steam line, called the cold reheat line.

Another aspect provides that the extraction line is connected to the steam line.

An aspect further compromises a valve located in the steam line either side of the connection point of the extraction line that fluidly and selectively connects the extraction line to either the outlet line or the first preheater.

An aspect further provides: a second preheater, in the boiler feed water line, downstream of the first preheater, wherein the turbine extraction line is fluidly connected to the second preheater to enable pre-heating of boiler feed water with extracted steam.

An aspect provides a method for operating a power plant comprising a boiler for heating process fluids and a multistage first steam turbine having an outlet line that passes through the boiler. The method includes the steps of monitoring a temperature of the first steam turbine outlet line, extracting steam from an intermediate stage of the first steam turbine, and using the extracted steam to heat at least one of the process fluids in order to control the monitored temperature.

A further aspect provides that the heating step includes heating process fluid in the outlet line between the boiler and the first steam turbine.

An aspect further provides feeding the boiler with boiler feed water wherein the process fluid of the heating step includes the boiler feed water.

It is a further object of the invention to overcome or at least ameliorate the disadvantages and shortcomings of the prior art or provide a useful alternative.

Other aspects and advantages of the present disclosure will become apparent from the following description, taken in connection with the accompanying drawings which by way of example illustrate exemplary embodiments of the present invention

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
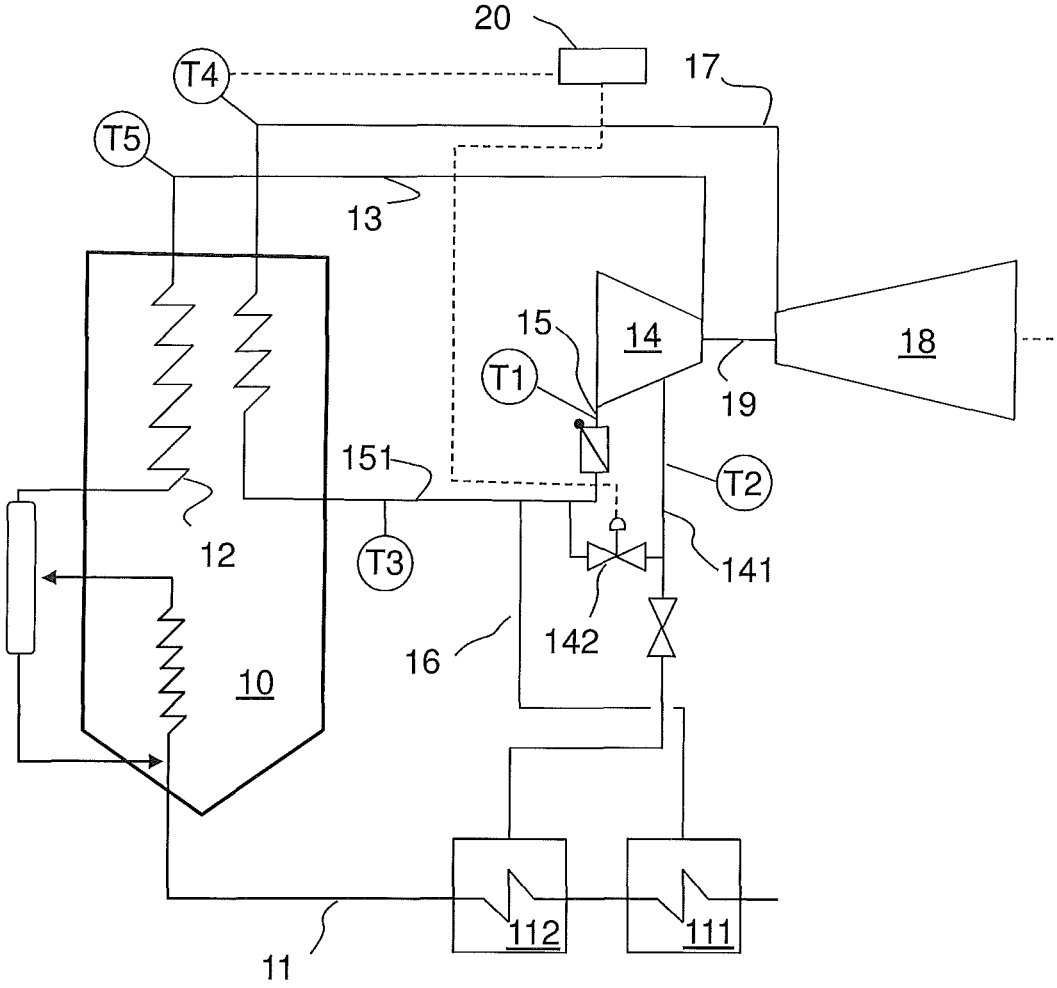
FIG. 1 is a schematic view of a power plant combining several preferred embodiments of the disclosure.

Exemplary embodiments of the present disclosure are now described with reference to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiments disclosed herein.

FIG. 1 shows a schematic diagram of a section of a steam power plant designed to provide power to a public power grid. The plant includes a boiler 10 for generating steam from a boiler feed water process fluid stream. As shown in FIG. 1, the boiler feed water passes through, by means of a boiler feed water line 11, an optional preheater 111 before further passing through the boiler 10. In different exemplary embodiments, the boiler 10 is either fired directly by fossil fuels, such as coal or gas, or by non-convection heat sources in the form of a secondary heat exchange cycle or else as is otherwise known in the industry.

The live steam is generated within a cascade of heat exchangers contained within the boiler 10 before exiting the boiler 10. The main steam line performs the function of a feed pipe 13 that is directed into the inlet of a first steam turbine 14. In an exemplary embodiment, the first steam turbine 14 is a high-pressure (HP) steam turbine with a plurality of turbine stages. At the exit of the HP steam turbine 14, partially expanded process fluid, in this case steam, is returned to the boiler 10 for reheating via an outlet line 15. The section of the outlet line 15 extending between the exhaust of the high-pressure steam turbine 14, which is after the steam turbine's last stage, and the boiler 10 defines a cold reheat line 151 section of the outlet line 15.

Before being connected to a second steam turbine 18, the outlet line 15 passes through the boiler 10. The last section of the outlet line 15 from the boiler to the second steam turbine 18 defines a hot reheat line 17 section. In an exemplary embodiment, the second steam turbine 18 is an intermediate-pressure (IP) steam turbine. In the embodiment shown in FIG. 1, the first and second steam turbines 14,18 share a single rotor 19 that drives a (not shown) generator. In other not shown exemplary embodiments, the steam turbines 14,18 have separate shafts. In a further complementary exemplary embodiment, the power plant comprises an additional IP steam turbine and/or one or more low pressure (LP) steam turbines which can have additional reheating circuits. As is evident from the following description, the principles of the present invention can be applied to any of these steam power plant configurations.

The power plant, as shown in FIG. 1, further includes an extraction line 141 that extracts steam from an intermediate stage of the first steam turbine 14. In this context, an intermediate stage is defined as a blade/vane combination fluidly located between the first stage or entry/inlet stage of the steam turbine 14 and the last or exit/exhaust stage of a steam turbine 14.

In various exemplary embodiments shown in FIGS. 1 and 2 and as described below, the extracted steam is used to heat process fluids entering the boiler 10 for the purpose of increasing or maintaining the temperature T4 of the hot reheat line 17 during, for example, periods of low plant load so as to prevent a drop in the hot reheat temperature T4 and the resulting loss in efficiency. These various exemplary embodiments may be applied independently or in addition to known methods of controlling hot reheat temperature T4.

In an exemplary embodiment shown in FIG. 1, the extracted steam is directed, via the extraction line 141, into the cold reheat line 151 so as to raise the inlet temperature T3 of steam flowing into the boiler 10. If a constant or similar heat input is applied to the boiler 10, the addition of steam from the extraction line 141 will result in an increased reheater outlet (RHO) steam temperature T4.

In an exemplary embodiment shown in FIG. 1, an extraction valve 142 in the extraction line 141 is configured to modulate the amount of extraction steam taken from the high pressure steam turbine 14 for the purpose of controlling the hot reheat temperature T4 by directing the extraction steam into the cold reheat (CRH) 15. The hot reheat temperature T4 is defined as the temperature of steam in the hot reheat line 17. This embodiment may further include a control system that comprises an extraction valve 142 and a controller 20 of a known type, for automatic control of the temperature of steam passing through the outlet line 15.

Depending on the design and operational parameters of the extraction control valve 142 the extraction steam may have a temperature T2 higher than the temperature T1 of cold reheat steam coming from the HP steam turbine exhaust. By mixing steam from the extraction line 141 with the HP exhaust steam in the cold reheat line 15 the steam temperature T3 at the inlet of the reheater is increased. As a result, the hot reheat temperature T4 can be maintained at the optimal operational level of the IP steam turbine 18, even at low loads.

As shown in FIG. 1, an exemplary embodiment includes a first preheater 111 located in the boiler feed water line 11. The purpose of the preheater is to increase the temperature of the boiler feed water as it enters the boiler 10, thus, for a given boiler load, influencing the relative temperature of main/live steam temperature T5, cold reheat temperature T3 and the hot reheat temperature T4. In an exemplary embodiment, a portion of cold reheat steam is directed, via a steam line 16, into the first preheater 111.

An exemplary embodiment shown in FIG. 1 further includes injecting extraction steam upstream of a point where a steam line 16 for the preheater 111,112 branches off from the first steam turbine outlet line 15. This increases the temperature of the cold reheat steam before it enters the preheater 111,112. As a result, a lower mass of steam is required to perform the same amount of pre-heat in the preheater 111, 112.

In another exemplary embodiment shown in FIG. 1, in addition to, or instead of extraction steam flowing into the cold reheat line 151, extraction steam is directed into a second preheater 112 located in the boiler feed water line 11. The second preheater 112 may either be located in series downstream of the first preheater, as shown in FIG. 1, or else may replace the first preheater 111. This arrangement enables the balancing of the live steam T5 and hot reheat steam T4, by enabling extraction steam to be alternatively directed only to the second preheater 112, only to the cold reheat line 151, to both the second preheater and cold reheat line 151 at the same time or else to neither the second preheater of the cold reheat line 151. This operational flexibility simplifies the temperature optimisation of power plant and thus enables the power plant to operate at a higher average efficiency.

Figure 2:
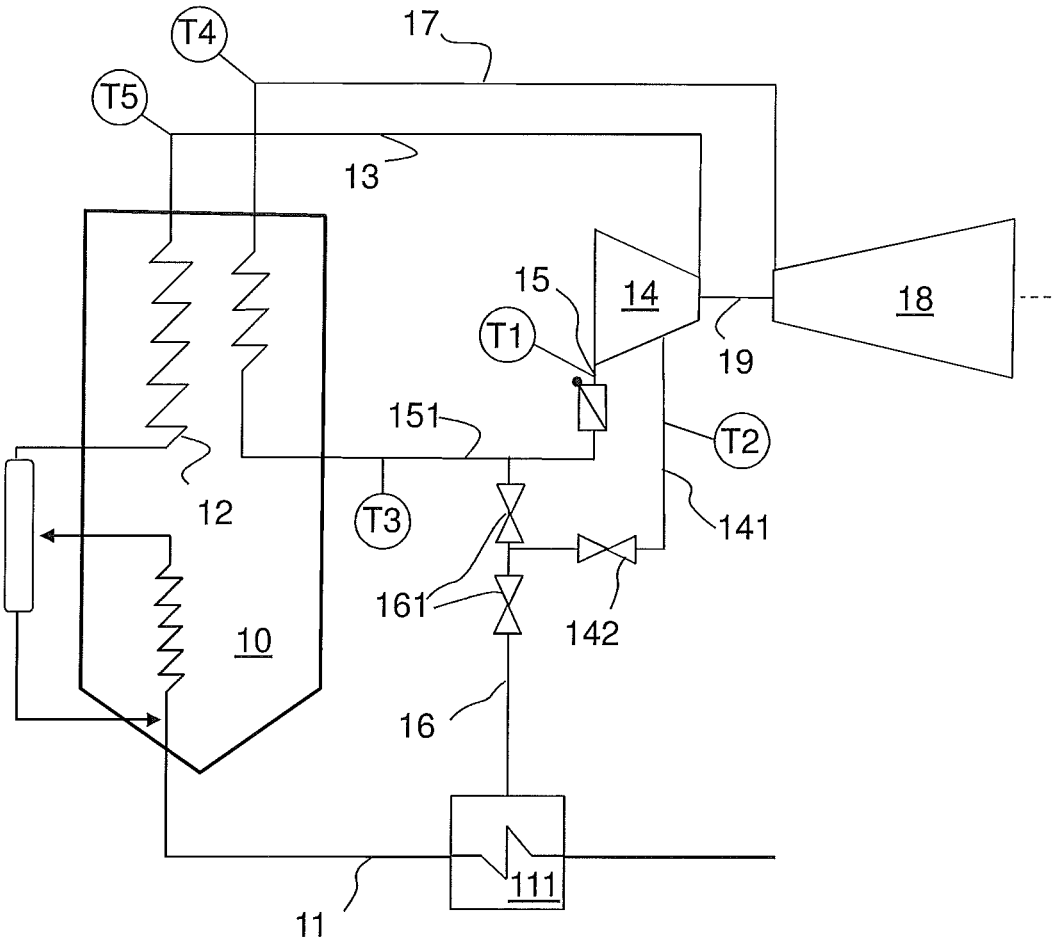
FIG. 2 is a schematic of another power plant combining several further preferred embodiments of the disclosure.

In an exemplary embodiment shown in FIG. 2 instead of the extraction line 141 being connected to the cold reheat line 151, the extraction line 141 is connected to the steam line 16 at a point between the cold reheat line 151 and the first preheater 111. By locating valves 161 either side of this connection point it is possible to selectively direct extraction steam either into the cold reheat line 151 or into the first preheater 111. This arrangement may be preferable to the alternative arrangement shown in FIG. 1 for retrofitting plants that were not originally configured for steam extraction.

Although the disclosure has been herein shown and described in what is conceived to be the most practical exemplary embodiments, it will be appreciated that the present disclosure can be embodied in other specific forms. The presently disclosed embodiments are therefore considered in all respects to be illustrative and not restrictive. Therefore scope of the disclosure is indicated by the appended claims rather that the foregoing description and all changes that come within the meaning and range and equivalences thereof are intended to be embraced therein.

The invention claimed is:

1. A power plant comprising:

a boiler for heating process fluids;

a multistage first steam turbine with an outlet line that passes through the boiler, the outlet line comprising an extraction line configured and arranged to extract steam from an intermediate stage of the first steam turbine and heat at least one of the process fluids; and a control system comprising:

an extraction control valve, in the extraction line, for modulating flowrate through the extraction line, wherein the extraction line is connected to the outlet line upstream of the boiler;

a temperature measurement device configured and arranged to measure a temperature (T3) of process fluid in the outlet line upstream of the boiler between the boiler and the first steam turbine; and a controller configured and arranged to modulate the extraction control valve based on the temperature measurement.

2. The power plant of claim 1 comprising:

a boiler feed water line that passes through the boiler;

a first preheater in the boiler feed water line upstream of the boiler; and a steam line, fluidly connecting the outlet line upstream of the boiler to the first preheater so as to enable pre-heating of boiler feed water passing through the boiler feed water line.

3. The power plant of claim 2 wherein the extraction line is connected to the outlet line upstream of the steam line.

4. The power plant of claim 2 wherein the extraction line is connected to the outlet line between the boiler and the steam line.

5. The power plant of claim 2 wherein the extraction line is connected to the steam line at a connection point.

6. The power plant of claim 5 compromising:

a valve, in the steam line, either side of the connection point to fluidly and selectively connect the extraction line to either the outlet line or the first preheater.

7. The power plant of claim 2 comprising:

a second preheater, in the boiler feed water line, downstream of the first preheater, wherein the extraction line is fluidly connected to the second preheater to enable pre-heating of boiler feed water pass thorough the boiler feed water line with extracted steam.

8. A method for operating a power plant that includes a boiler for heating process fluids and a multistage first steam turbine having an outlet line that passes through the boiler, the method comprising:

monitoring a temperature (T1, T3, T4) of the outlet line upstream of the boiler between the boiler and the first steam turbine;

extracting steam from an intermediate stage of the first steam turbine via an extraction control valve connected to the outlet line upstream of the boiler; and using the extracted steam to heat at least one of the process fluids in order to control the monitored temperature (T1, T3, T4).

9. The method of claim 8 wherein the heating step includes heating process fluid in the outlet line between the boiler and the first steam turbine.

10. The method of claim 8 further including feeding the boiler with boiler feed water wherein the process fluid of the heating step includes the boiler feed water.

* * * * *